United States Patent [19]

Hesterberg et al.

[11] Patent Number: 4,966,220

[45] Date of Patent: Oct. 30, 1990

[54] EVAPORABLE FOAM CASTING SYSTEM UTILIZING A HYPEREUTECTIC ALUMINUM-SILICON ALLOY

[75] Inventors: William G. Hesterberg, Rosendale; Raymond J. Donahue, Fond du Lac; Terrance M. Cleary, Allenton, all of Wis.

[73] Assignee: Brunswick Corporation, Skokie, Ill.

[21] Appl. No.: 340,555

[22] Filed: Apr. 14, 1989

Related U.S. Application Data

[63] Continuation-in-part of Ser. No. 94,393, Sep. 8, 1987, abandoned.

[51] Int. Cl.[5] ..... B22C 9/04

[52] U.S. Cl. ..... 164/34; 164/35

[58] Field of Search ..... 164/34, 35

[56] References Cited

U.S. PATENT DOCUMENTS

| | | | |
|---|---|---|---|
| 1,947,121 | 2/1937 | Bonsack . | |
| 2,357,452 | 9/1944 | Bonsack . | |
| 3,092,744 | 6/1963 | Stonebrook . | |
| 3,726,672 | 4/1973 | Lindberg et al. . | |
| 3,861,447 | 1/1975 | Hoado | 164/34 |
| 3,863,706 | 2/1975 | Chandley | 164/255 |
| 3,881,879 | 5/1975 | Singelton, Jr. | 29/193 |
| 3,900,064 | 8/1975 | Chandley et al. . | |
| 4,112,997 | 9/1978 | Chandley | 164/119 |
| 4,297,976 | 11/1981 | Bruni | 123/193 |
| 4,340,108 | 7/1982 | Chandley et al. | 164/63 |
| 4,603,665 | 8/1986 | Hesterberg et al. | 123/195 |
| 4,616,689 | 10/1986 | Denis | 164/34 |
| 4,711,288 | 12/1987 | Harvey | 164/34 |

FOREIGN PATENT DOCUMENTS

| | | |
|---|---|---|
| 1166813 | 5/1984 | Canada . |
| 54-39311 | 3/1979 | Japan . |
| 1437144 | 5/1976 | United Kingdom . |

OTHER PUBLICATIONS

Alloy Digest, Reynolds 390 and A390, Aug. 1971.
Alloy Digest, Aluminum 392.0, Sep. 1970.
Ward's Engine Update, "Top Engine Designers Laud Sleeveless Alloy Use", May 1982.
"Engineering Control For High Volume 390 Die Casting", Ward.
"Aluminum Alloy with High Silicon Content", Stonebrook.
"Evaporative Foam Casting Technology II Program", 1986.

*Primary Examiner*—Kuang Y. Lin
*Attorney, Agent, or Firm*—Andrus, Sceales, Starke and Sawall

[57] ABSTRACT

A method of casting utilizing an evaporable foam system with a hypereutectic aluminum silicon alloy. The molten alloy is introduced into a mold in contact with an evaporable foam pattern formed of polystyrene, or the like. The heat of the molten alloy will decompose and vaporize the pattern and the vapor will enter the interstices of the surrounding sand, while the molten alloy will fill the void caused by the vaporization of the pattern. By casting the molten alloy into contact with the evaporable foam material, a more uniform distribution of primary silicon is obtained in the cast alloy and the heat of crystallization caused by precipitation of silicon crystals on solidification of the alloy will temporarily slow the solidification rate of the alloy, thus increasing the time for elimination of pattern residue vapors from the molten alloy.

7 Claims, 1 Drawing Sheet

EVAPORABLE FOAM CASTING SYSTEM UTILIZING A HYPEREUTECTIC ALUMINUM-SILICON ALLOY

RELATED APPLICATION

This application is a continuation-in-part of application Ser. No. 07/094,393, filed Sept. 8, 1987, now abandoned.

BACKGROUND OF THE INVENTION

Aluminum alloys, due to their light weight, have been used for casting engine blocks for internal combustion engines. Hypereutectic aluminum silicon alloys containing from 16% to 19% by weight of silicon are known to possess good wear resistant properties, achieved by the precipitated silicon crystals which constitute the primary phase.

U.S. Pat. No. 4,603,665 describes an improved hypereutectic aluminum silicon casting alloy having particular use in casting engine blocks for marine engines. The alloy of the aforementioned patent contains by weight from 16% to 19% silicon, up to 1.4% iron, 0.4% to 0.7% magnesium, up to 0.3% manganese, up to 0.37% copper, and the balance aluminum. By minimizing the copper content in the alloy, the ternary aluminum-silicon-copper eutectic is avoided and the resulting alloy has a relatively narrow solidification temperature range.

The alloy of U.S. Pat. No. 4,603,665, with a copper level below 0.37% by weight, solidifies over a temperature range about 45% less than the temperature range for the alloy with 4.5% copper and also shows significant improvement in microporosity in the solidified structure. However, with the use of the alloy of U.S. Pat. No. 4,603,665, in sand casting of large items, such as engine blocks, there is significant floatation of primary silicon particles into risers, resulting in a non-uniform distribution of primary silicon in the cast engine block. As the precipitated silicon is primarily responsible for the wear resistance of the alloy, a non-uniform distribution of primary silicon will adversely affect the wear resistance of the alloy.

Evaporable foam casting is a known technique in which a pattern formed of an evaporable foam material is supported in a mold and surrounded by an unbonded particulate medium, such as sand. When the molten metal contacts the pattern, the foam material vaporizes, with the vapor passing into the interstices of the sand, while the molten metal replaces the void formed by the vaporized foam material.

In an evaporable foam casting process, it is desirable to slow the solidification rate of the molten metal to provide time for the elimination of vapors generated by the decomposition of the pattern from the molten alloy. If the molten metal solidifies too swiftly, decomposition producers of the foam material can be entrapped in the metal, resulting in porosity and a loss of mechanical properties.

SUMMARY OF THE INVENTION

The invention is directed to an evaporable foam casting system utilizing an evaporable polymeric foam pattern in combination with a hypereutectic aluminum silicon alloy, and this combination provides a slower solidification rate for the alloy to provide high quality castings, as well as providing more uniform distribution of primary silicon in the solidified alloy.

The alloy to be used in the casting method of the invention is a hypereutectic aluminum-silicon alloy containing up to 30% silicon and in a preferred form of the invention, the alloy contains by weight from 16% to 19% silicon, 0.4% to 0.7% magnesium, up to 1.4% iron, up to 0.3% magnesium, up to 0.37% copper and the balance aluminum. Due to the minimum copper content, the ternary aluminum-silicon-copper eutectic is avoided and the alloy has a relatively narrow solidification range.

In the casting procedure, a pattern having a configuration proportionally identical to the component to be cast and composed of an evaporable polymeric material, such as polystyrene or polymethylmethacrylate, is placed in a mold and a freely flowable material, such as sand, surrounds the pattern as well as filling the internal cavities of the pattern.

When the molten alloy contacts the evaporable foam pattern in the mold, the heat of the alloy will decompose the foam material to vaporize the foam, the vapor passing into the interstices of the surrounding sand and the molten alloy filling the void created by vaporization of the foam material. Solidification of the hypereutectic alloy occurs in conjunction with the precipitation of primary silicon crystals. As the alloy contains a substantial quantity of silicon, preferably above 16% by weight, the heat of crystallization slows the solidification rate temporarily, increasing the fluidity and thus allowing additional time for the elimination of pattern residue vapors from the molten alloy. The increase in fluidity rate also permits casting of relatively thin sections or filling isolated areas of the pattern located relatively long distances from the ingate. These advantages are realized without increasing the initial pouring temperature of the molten alloy, nor through use of an alloy with a relatively large solidification range, which could cause segregation on solidifying.

The use of the evaporable foam pattern also changes the turbulent flow of molten alloy, which occurs when the alloy is introduced into an open cavity as in sand casting, to a near laminar flow and the laminar flow promotes a more uniform distribution of primary silicon in the solidified alloy to improve the wear resistant characteristics of the cast alloy.

When the foam casting process is used with hypereutectic aluminum-silicon, an interaction occurs with the foam causing an improvement in the "primary silicon and eutectic" microstructure that benefits the physical properties of the alloy, and this result is not suggested nor taught by the prior art which deals with a "primary aluminum and eutectic" microstructure of the hypoeutectic aluminum-silicon alloys.

The cast alloy produced by the method of the invention has inherent soundness attributable to the relatively narrow solidification range, good corrosion resistance, and excellent wear resistance due to the precipitated silicon.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
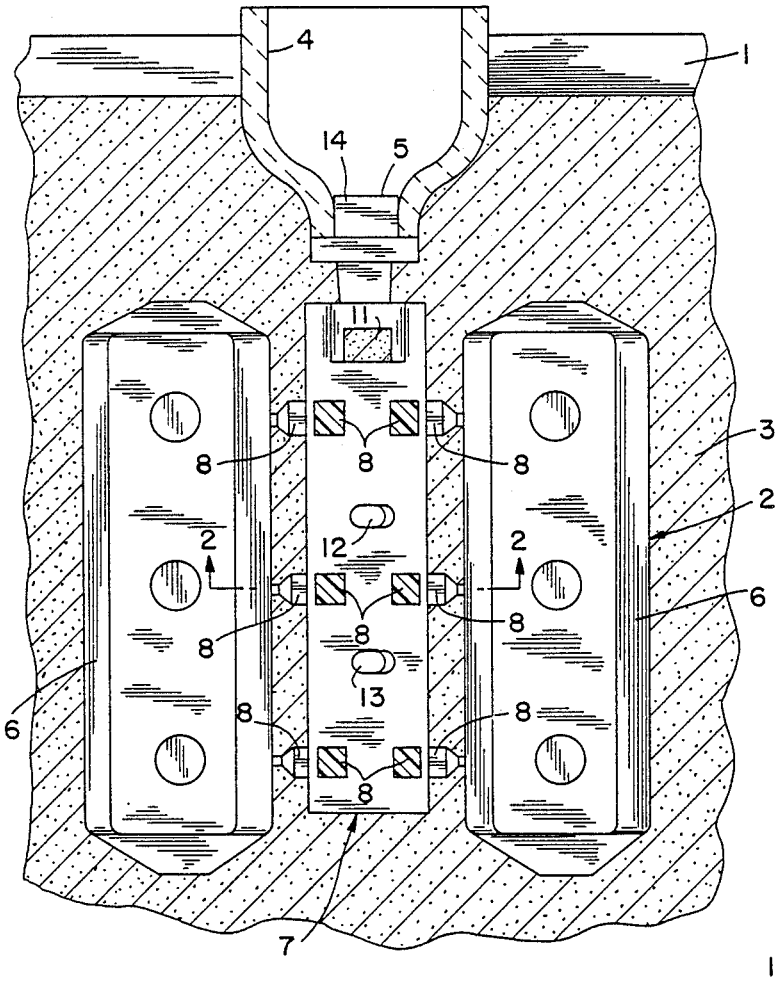
FIG. 1 is a longitudinal section of a typical evaporable foam casting system that can be utilized with the invention.

FIG. 1 illustrates a typical evaporative foam casting system which can be utilized in the invention. As illustrated, the casting system includes a mold 1 and a pattern assembly 2 is supported within the mold and surrounded by an unbonded particulate material 3, such as sand. The molten alloy is introduced into the mold through a funnel 4 which communicates with inlet assembly 5 of pattern assembly 2.

Pattern assembly 2 includes a group of patterns 6 corresponding in configuration to the part to be cast and which are formed of an evaporative foam material, such as expanded polystyrene or polymethylmethacrylate The construction of the evaporable foam resin casting system is not critical and may take the form of that described in U.S. Pat. No. 4,721,149.

Figure 2:
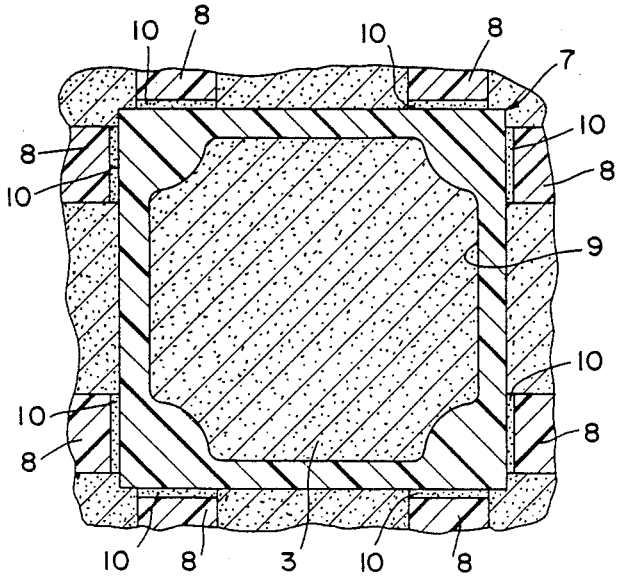
FIG. 2 is a section taken along line 2—2 of FIG. 1.

Patterns 6 are supported from a central sprue 7 by a plurality of ingates 8 which can be formed of the same evaporable foam material as the patterns. As illustrated in FIG. 2, the sprue is generally rectangular in horizontal cross section having a central opening 9 and an open bottom. Two vertical rows of ingates 8 are associated with each side surface of sprue 7 and each row of ingates is connected to one of the patterns 6, so that, as illustrated, eight patterns are supported from the sprue 7.

As shown in the drawings, ingates 8 are formed integrally with the respective pattern 6, and the inner flat end of each ingate is attached to the respective surface of sprue 7 through a layer of adhesive 10. The adhesive is a conventional type which will be vaporized by the heat of the molten alloy as it is introduced into the sprue and the vapor generated by vaporization of the adhesive will pass into the interstices of the sand.

As described in the aforementioned patent, ingates 8, alternately, can be integrally formed with sprue 7 and thus connected to he patterns 6 through use of a layer of adhesive, or the ingates can be separate pieces and connected through adhesives to both the patterns 6 and the sprue 7.

Figure 3:
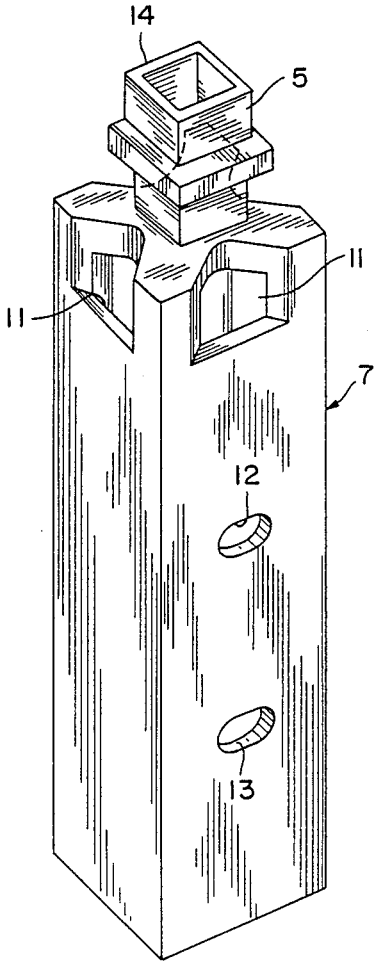
FIG. 3 is a perspective view of the sprue.

As best illustrated in FIG. 3, the upper end of each side surface of sprue 7 is provided with an opening or recess 11 through which sand can flow into the interior chamber 9 of the sprue. In addition, opposite surfaces of the sprue are provided with openings 12 and 13, which also serve to admit sand to the internal chamber 9.

Inlet assembly 5 includes a generally rectangular inlet member 14 formed of an evaporable foam material, such as polystyrene, and having a closed bottom, as shown in FIG. 3.

In a conventional evaporable foam casting process, the foam pattern is usually coated with a porous ceramic material which tends to prevent a metal/sand reaction and facilitates cleaning of the cast metal part. The ceramic coating is normally applied by immersing the pattern in a bath of ceramic wash, draining the excess wash from the pattern and drying the wash to provide the porous ceramic coating.

The alloy to be used in the process of the invention is a hypereutectic aluminum silicon alloy containing up to 30% by weight of silicon. An example of an alloy to be used is that described in U.S. Pat. No. 4,603,665, which contains, by weight 16% to 19% silicon, 0.4% to 0.7% magnesium, up to 1.4% iron, up to 0.3% manganese, up to 0.37% copper, and the balance aluminum. The magnesium acts to cause the alloy to respond to an age hardening heat treatment, while the iron and manganese tend to neutralize each other relative to a loss of ductility caused by iron. The resulting alloy has increased machinability, with more stable mechanical properties at elevated temperatures.

The copper content is maintained below 0.37% and preferably at a minimum. As the copper content is minimized, the aluminum-silicon-copper eutectic is correspondingly eliminated with the result that the alloy has a relatively narrow solidification range, generally below 150° F., and preferably less than 100° F.

The alloy has a yield strength of 15,000 to 30,000 psi, an ultimate tensile strength in the range of 20,000 to 35,000 psi, and an elongation of 0% to 2.0%.

Specific examples of the hypereutectic aluminum-silicon alloy to be used in the invention are as follows in weight percent:

| EXAMPLE I | |
|---|---|
| Silicon | 16.90 |
| Iron | 0.92 |
| Copper | 0.14 |
| Manganese | 0.12 |
| Magnesium | 0.41 |
| Aluminum | 81.51 |
| Solidification Range | 79° F. |

| EXAMPLE II | |
|---|---|
| Silicon | 16.80 |
| Iron | 1.03 |
| Copper | 0.33 |
| Manganese | 0.18 |
| Magnesium | 0.50 |
| Aluminum | 81.16 |
| Solidification range | 86° F. |

When the molten alloy at a temperature below 1400° F. and generally at a temperature in the range of 1250° F. to 1400° F. is introduced into funnel 4, it will flow downwardly to the pattern assembly 2 and heat of the molten metal will vaporize the foam material of the inlet assembly 5, sprue 7, ingates 8, and the patterns 6, with the resulting vapors passing through the porous ceramic coating and into the interstices of the sand 3.

On cooling from solution, the silicon in the hypereutectic alloy precipitates as relatively large crystals which generate substantial heat of crystallization. The heat of crystallization generated by precipitation of the silicon crystals slow the solidification rate, by nonexternal means, while within the physical/thermodynamic constraints of nature.

The use of the hypereutectic aluminum silicon alloy in an evaporable foam casting process has distinct and unexpected advantages. The precipitation of silicon crystals and the resulting increase in fluidity allows additional time for the escape of vapors from the molten alloy, thereby minimizing gas porosity in the solidified alloy.

When the foam pattern is vaporized by the heat of the molten metal, the heat of vaporization of the foam draws heat from the molten metal, tending to cool the molten metal. However, the heat of crystallization generated by precipitation of the silicon crystals compensates for the loss of heat due to vaporization of the foam, so that the molten metal will have the desired fluidity to fill isolated areas of the pattern.

The choice of silicon is ideal for this purpose because silicon has the highest heat of fusion of any element in the periodic table. As the solidification rate is slowed, the method of the invention permits relatively thin or complicated sections to be cast and also permits isolated areas of the pattern, located a relatively long distance from the ingate to be cast without defects. This is particularly significant when dealing with evaporable foam patterns which, by their very nature, can be formed into complex shapes and configurations.

In an evaporable foam casting process, the flow of the molten metal into the cavity, which contains the foam pattern, is essentially laminar flow, as opposed to casting into an open cavity where the molten metal tumbles or circulates in the open cavity to provide a turbulent flow. During casting in the evaporable foam process, the leading edge of the molten metal runner will move in a generally laminar path to progressively contact and vaporize the foam. As the molten metal progressively advances, it is important that the molten metal have excellent fluidity, so that the molten metal will not solidify before reaching isolated areas of the pattern. Thus, the heat generated by the precipitation of the silicon crystals is extremely important when dealing with evaporable foam casting procedures, in that it slows the solidification rate and effectively increases the fluidity of the molten metal.

As a further and unexpected result, the utilization of the evaporable-foam pattern changes the normal turbulent filling as occurs in open cavity casting to a near laminar flow and the laminar flow produces a more uniform distribution of primary silicon in the solidified alloy. While the mechanics are not fully understood, it is believed that the foam goes through phase transformations from solid-to-liquid-to-gas phase on near contact with molten metal, causing the liquid/gas phase decompositional products to be transported through the ceramic wash coat and to enter the interstices of the sand at the same rate the liquid metal fills the intended casting shape. Secondly, it is believed that the moving liquid interface, restrained by decomposing foam, has attributes that contribute to a more uniform distribution of primary silicon because the energy dynamics of the moving liquid interface does not result in any adverse pushing or absorption of the primary silicon at the interface. Thus, the casting of a hypereutectic aluminum-silicon alloy into foam results in a microstructure having a more uniform distribution of primary silicon than is observed for similarly cast sand castings, poured at the same temperature.

Wear application require primary silicon to be uniformly distributed in the microstructure. The uniformity of the primary silicon is not a particle size measurement, related solely to a static nucleation and growth phenomena; it is a volume fraction measurement, related to a complex precipitation phenomena and the mass flux changes brought on by growth and floatation, with the heat balance central to the fundamental understanding. The uniformity of the primary silicon distribution is, thus, the "spread" in the average silicon concentration seen "under a microscope" because it is at that level where silicon particles must carry the load in preference to the matrix and functionally resist wear from a mating surface. To adhere to quantative measurement standards, the best measure of the spread in the primary silicon volume fraction seen in the microstructure is chosen as the well known coefficient of variation parameter used in statistics. In making these measurements, at least 25 individual cross sectional fields of view measuring 5.86 $mm^2$ are taken under a microscope interfaced to a computer for quantitative analysis with the field of view magnified 50× and containing, on average, at least 50 primary silicon articles in each field of view.

The following table shows a comparison of the coefficient of variation of primary silicon volume fraction between identical hypereutectic aluminum-silicon alloys, one used in open cavity sand casting and the second used in casting an identical component with an evaporable foam pattern formed of polystyrene. The alloy used in both the sand casting and evaporable foam casting consists by weight of 17% silicon, 0.1% iron, 0.2% manganese, 0.6% magnesium, 0.15% copper and the balance aluminum.

TABLE I

| | Coefficient of Variation Primary Silicon Volume Fraction |
|---|---|
| Open Cavity Sand Casting | 63.0% |
| Evaporable Foam Casting | 47.1% |

The results of the comparative test, as set forth in the above table show the coefficient of variation of the primary silicon volume fraction being decreased from 63.0% to 47.1%, thereby evidencing a significant and unexpected improvement in the distribution of primary silicon in the cast alloy when using an evaporable foam pattern, as opposed to open cavity casting.

Therefore, through use of the combination of the hypereutectic aluminum-silicon alloy and the evaporable foam material, the solidification rate of the alloy is not only slowed, to increase the time for elimination of pattern residue vapors, but a significant improvement in the distribution of primary silicon in the solidified alloy is obtained which improves the wear resistance of the alloy.

Various modes of carrying out the invention are contemplated as being within the scope of the following claims particularly pointing out and distinctly claiming the subject matter which is regarded as the invention.

We claim:

1. A method of casting, comprising the steps of preparing a molten hypereutectic aluminum silicon alloy containing by weight up to 30% silicon, casting said molten alloy into a mold comprising an evaporable foam pattern surrounded by a finely divided medium, the heat of said molten alloy acting to vaporize said pattern with the vapor passing into and being retained within said medium and said molten alloy filling the void resulting from the vaporization of said pattern, and precipitating primary silicon from said molten alloy as said alloy cools to provide a cast alloy containing precipitated primary silicon, said cast alloy having decreased microporosity and having a more uniform distribution of said primary silicon.

2. A method of casting contoured components for an internal combustion engine, comprising the steps of preparing a molten hypereutectic aluminum silicon alloy containing by weight from 16% to 19% silicon, forming an evaporable foam pattern having a shape substantially identical to a component of an internal combustion engine, supporting said evaporable foam pattern in a mold, connecting said pattern through a sprue with the exterior of the mold, filling the mold with an unbonded finely divided medium to surround said pattern, introducing said alloy through said sprue to said pattern with the heat of said molten alloy acting to vaporize said pattern with the vapor passing into and being contained within said medium and said molten alloy filling the void created by vaporization of said pattern to provide a cast alloy component, and cooling the molten hypereutectic alloy to precipitate silicon from said alloy as relatively large crystals and generate heat of crystallization to retard the cooling rate of said alloy and permit said vapor to completely escape into said medium.

3. The method of claim 1, and including the step of maintaining said molten alloy at a temperature below 1400° F.

4. The method of claim 2, and including the step of forming the pattern from expanded polystyrene.

5. A method of casting, comprising the steps of preparing a molten hypereutectic aluminum silicon alloy containing by weight at least 16% silicon, casting said molten alloy into a mold comprising an evaporable foam pattern surrounded by a finely divided material, vaporizing said pattern by the heat of said molten alloy with the vapor passing into and being retained within said material and said molten alloy filling the void resulting from the vaporization of said pattern, and generating heat internally of said molten alloy in said mold by precipitating silicon as silicon crystals from said alloy to thereby retard the cooling rate of said molten alloy and permit said vapor to escape into said material.

6. The method of claim 5, wherein said alloy contains up to 30% by weight of silicon.

7. The method of claim 5, wherein said alloy contains from 16% to 19% by weight of silicon and contains less than 0.37% by weight of copper.

* * * * *